US009741505B2

(12) United States Patent
Choi et al.

(10) Patent No.: US 9,741,505 B2
(45) Date of Patent: Aug. 22, 2017

(54) PUSH SWITCH OF OUTSIDE HANDLE OF DOOR

(71) Applicant: Hyundai Motor Company, Seoul (KR)

(72) Inventors: Dong Wuk Choi, Yongin-si (KR); Jong Hae Lee, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 56 days.

(21) Appl. No.: 14/842,419

(22) Filed: Sep. 1, 2015

(65) Prior Publication Data

US 2016/0111231 A1 Apr. 21, 2016

(30) Foreign Application Priority Data

Oct. 17, 2014 (KR) ..... 10-2014-0140467

(51) Int. Cl.

| | |
|---|---|
| ***H01H 13/14*** | (2006.01) |
| ***H01H 13/08*** | (2006.01) |
| ***E05B 81/76*** | (2014.01) |
| *H01H 13/06* | (2006.01) |

(52) U.S. Cl.

CPC ..... *H01H 13/14* (2013.01); *E05B 81/76* (2013.01); *H01H 13/08* (2013.01); *H01H 13/06* (2013.01); *H01H 2221/044* (2013.01); *H01H 2221/058* (2013.01)

(58) Field of Classification Search

CPC .. H01H 13/14; H01H 13/08; H01H 2221/044; H01H 13/06; H01H 2221/058; E05B 85/08

USPC ..... 200/344, 5 R, 5 A, 553, 557, 339

See application file for complete search history.

(56) References Cited

U.S. PATENT DOCUMENTS

| | | | | |
|---|---|---|---|---|
| 5,530,621 | A | 6/1996 | Choy et al. | |
| 7,057,124 | B2 * | 6/2006 | Ieda | E05B 81/76 200/520 |
| 7,763,819 | B2 * | 7/2010 | Ieda | E05B 81/76 200/600 |
| 7,884,293 | B2 * | 2/2011 | Ulomek | E05B 81/76 200/61.76 |
| 9,487,974 | B2 * | 11/2016 | Saitou | H01H 13/06 |

FOREIGN PATENT DOCUMENTS

| | | | |
|---|---|---|---|
| JP | 5-72025 | U | 9/1993 |
| JP | 2006-100013 | A | 4/2006 |
| KR | 10-1994-0022611 | A | 1/1999 |
| KR | 20-1999-0008540 | U | 3/1999 |
| KR | 10-2005-0047791 | A | 5/2005 |
| KR | 10-2005-0047798 | A | 5/2005 |
| KR | 10-2012-0029582 | A | 3/2012 |

* cited by examiner

*Primary Examiner* — Edwin A. Leon

(74) *Attorney, Agent, or Firm* — McDermott Will & Emery LLP

(57) ABSTRACT

A push switch of an outside handle of a door having a button installed inside a grip cover, wherein the button is attached to the inner surface of the grip cover through a support extending from a side of the button, and a tact switch pressed when the button is pushed.

7 Claims, 7 Drawing Sheets

[ Before operation ]

[ After operation ]

PUSH SWITCH OF OUTSIDE HANDLE OF DOOR

CROSS-REFERENCE TO RELATED APPLICATION

This application claims under 35 U. S. C. §119(a) the benefit of priority to Korean Patent Application No. 10-2014-0140467 filed on Oct. 17, 2014, the entire content of which is incorporated herein by reference.

TECHNICAL FIELD

The present disclosure relates to a push switch of an outside handle of a door. More particularly, it relates to a push switch of an outside handle of a door in which inclination, sloping, jamming, leaning, and other disadvantages of a button may be reduced.

BACKGROUND

There are several vehicle-door-related devices both inside and outside a vehicle, including a lock, a door latch for opening the door, inside and outside handles, a door lock mechanism enabling the door to be locked and unlocked using a key, and a safety knob that maintains the door lock state.

In general, a driver inserts a key into the door lock's key cylinder and turns the key. The rotating force thereof is transmitted to the door latch via a mechanical linkage so that the door can be locked or unlocked.

Alternatively, the door may be locked or unlocked by manipulating buttons of a remote controller (a fob key), or with a smart key. When a smart-key system is applied, a driver presses a button of a push switch in the outside handle to release the door lock and pulls the outside handle to open the door.

In a vehicle with a smart-key system and a button-starting system installed, a driver with the smart key may start the vehicle without inserting and rotating the key. After the driver enters the vehicle, the driver pushes only a starter button of the button starting system, increasing driver convenience.

FIGS. 1 to 3 show a push switch provided in an outside handle of a vehicle in which a smart key system is mounted to lock and unlock a door of the vehicle. FIG. 1 illustrates a handle grip 10, a grip cover 20, and a button 31 of a push switch 30 installed to the grip cover 20 side of an outside handle 1.

When the button 31 of the push switch 30 installed inside the grip cover 20 is pushed, the door can be locked or unlocked. When the door is unlocked, the handle grip 10 of the outside handle is pulled to open the door.

As illustrated in FIG. 2, the grip cover 20 is installed with the plastic button 31 exposed to the outside via a hole 21 and a tact switch is positioned inside the grip cover 20 to be pressed by a pressing protrusion 32 of the button 31 when the button 31 is pressed.

When the button 31 is pushed, the pressing protrusion 32 pushes the tact switch 36 such that the 36 outputs an electric signal to lock or unlock the door.

The tact switch 36 is covered at the outer side with a rubber seal such that the button 31 may be operated and returned to the original position by the rubber seal of the tact switch 36.

In addition, as illustrated in FIG. 3, an edge of the button 31 has a stepped shape such that the stepped edge of the button is in contact with a rim of the hole 21 of the cover 20 when the button 31 is inserted into the hole 21 of the cover 20.

A guide rib 22 protrudes on the inner surface of the grip cover 20 along the rim of the hole 21 to guide the movement of the button when the button 31 is pushed. A raised portion 37 of the upper surface of the tact switch 36 is inserted into the button 31 when the pressing protrusion 32 is inserted into the tact switch 36.

In this configuration, the movement and the position of the button 31 are controlled by the guide rib 22 of the grip cover 20.

In existing push switches, the shape of the guide rib 22 may not be sufficiently long in the operating direction due to the size limit of the handle, and sloping may occur, as illustrated in FIG. 4, as the button 31 is inclined and the inclination may cause jamming.

For instance, the button 31 may be pushed against the guide rib 22 of the grip cover 20 by the reaction force of the rubber material of the tact switch 36. When this occurs, the button may become inclined because the pressing protrusion 32 may rotate about the pressing protrusion 32.

Moreover, when the gap between the button and the rim of the hole (the guide of the grip cover 20 including the guide rib 22) is reduced, to prevent the button 31 from moving, the contact area between the button 31 and the rim of the hole increases. In these conditions, it may be difficult to operate the button when moisture enters and becomes frozen.

In addition, over-distribution of the rubber material in the tact switch 36 makes managing the operating force difficult.

In other words, the operating force of the button is determined according to the overlap between the pressing protrusion 32 of the button 31 and the rubber seal of the tact switch 36 (See FIG. 3). Increasing the amount of this overlap enhances the sensitivity of the button but exceeding the optimal amount of this overlap may cause the rubber seal of the tact switch to tear.

Also, because of the gap between the button and the rim of the hole (the guide of the grip cover 20 including the guide rib 22), the button may become misaligned. Mismatching of the hole of the grip cover 21 and the button 31 detracts from the appearance of the door handle.

SUMMARY OF THE DISCLOSURE

The present disclosure is made in an effort to solve the above-mentioned problems, and it is an aspect of the present inventive concept to provide a push switch of an outside handle of a door which reduces inclination, sloping, jamming, leaning, and other problems associated with a button of a push switch. The present disclosure also reduces the difficulty in operating a button under conditions caused by frozen moisture.

The present disclosure provides a push switch of an outside handle of a door that reduces the difficulty in managing the necessary operating force and decreases the probability of button leaning, and as such reduces the potential for a deteriorated appearance caused by the mismatching of the grip cover hole and the button.

The present disclosure also provides a push switch of an outside handle of a door, including: a button installed inside a grip cover exposed to the outside through a hole of the grip cover and hinged and supported to the inner surface of the grip cover through supports extending from both sides thereof; and a tact switch pressed and operated when the button is pushed.

The push switch may further include: a hinge formed at an end of the support; and a coupling unit, formed on the inner surface of the grip cover and into which the hinge is coupled, to guide the hinge toward the central portion of the button when the button is pushed.

The push switch may further include a bending concave portion formed on the support of the button and bent when the button is pushed.

The hinge may extend perpendicularly from the ends of the supports and be inserted into the coupling unit.

The hinge that is inserted into the coupling unit may have a circular cross-section.

The coupling unit that protrudes from the inner surface of the grip cover may have an 'L'-shape to limit the motion of the hinge coupled into the coupling unit in the upward and downward directions as the operating direction of the button.

The push switch of an outside handle of a door according to the present disclosure has the following effects.

Both sides of the button may be supported on an inner surface of the grip cover by the hinge-coupling structure so that leaning, sloping, jamming, and leaning of the button during operation may be reduced. The present disclosure also reduces the difficulty in operating a button under conditions caused by frozen moisture.

Moreover, the present disclosure prevents the deteriorated appearance caused by mismatching between the hole of the grip cover and the button. In addition, tuning and managing the operating force may be easier because the operating force is applied by the elastic deformation of a support in the plastic button.

BRIEF DESCRIPTION OF THE DRAWINGS

The above and other features of the present disclosure will now be described in detail with reference to certain exemplary embodiments thereof illustrated in the accompanying drawings which are given hereinbelow by way of illustration only, and thus are not limitative of the present inventive concept, and wherein.

It should be understood that the appended drawings are not necessarily to scale, presenting a somewhat simplified representation of various features illustrative of the basic principles of the present disclosure. The specific design features of the present inventive concept as disclosed herein, including, for example, specific dimensions, orientations, locations, and shapes will be determined in part by the particular intended application and use environment.

In the figures, the same reference numbers refer to the same or equivalent parts of the present disclosure throughout the several figures.

DETAILED DESCRIPTION

Hereinafter, the present inventive concept will be described in detail so that those skilled in the art to which the present disclosure pertains can easily carry out the present inventive concept.

Figure 1:
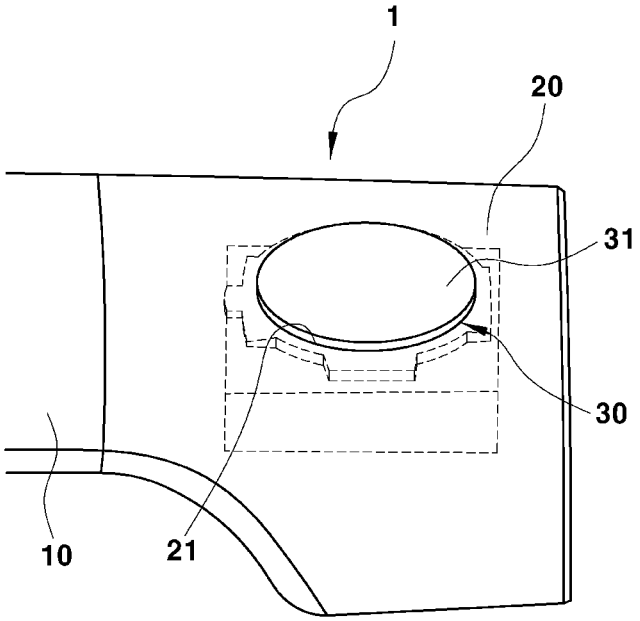
FIG. 1 Prior Art
FIGS. 1 to 3 are views showing an existing push switch.
Figure 2:
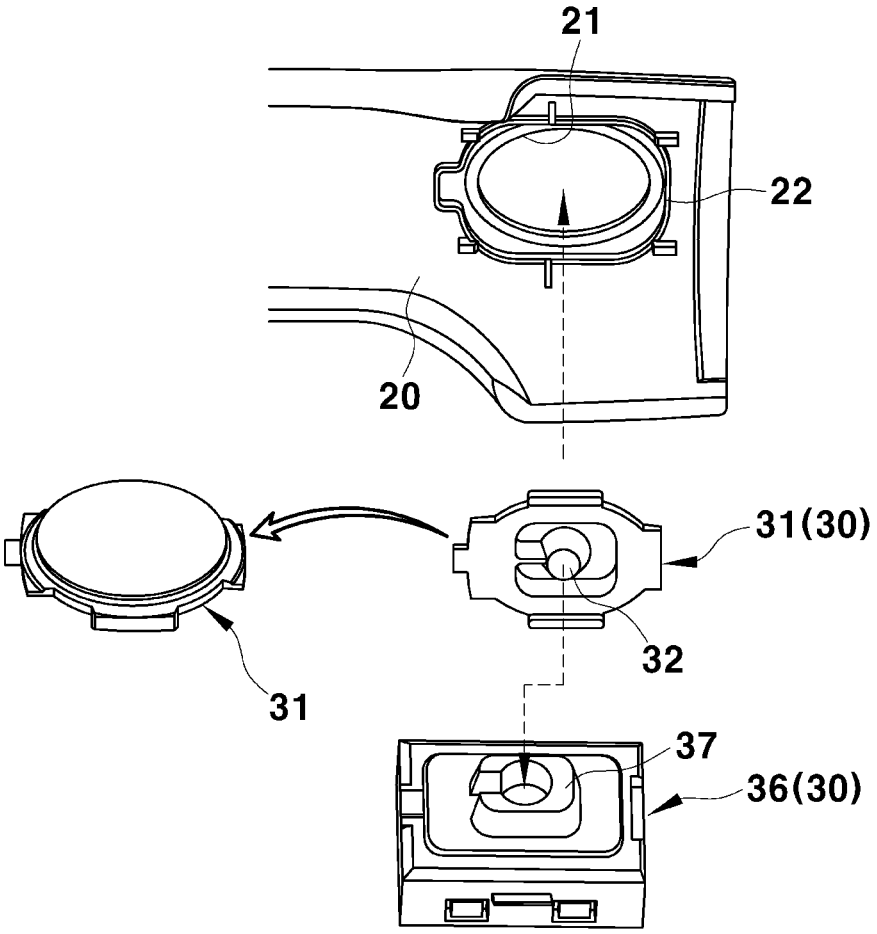
FIG. 2 Prior Art
Figure 3:
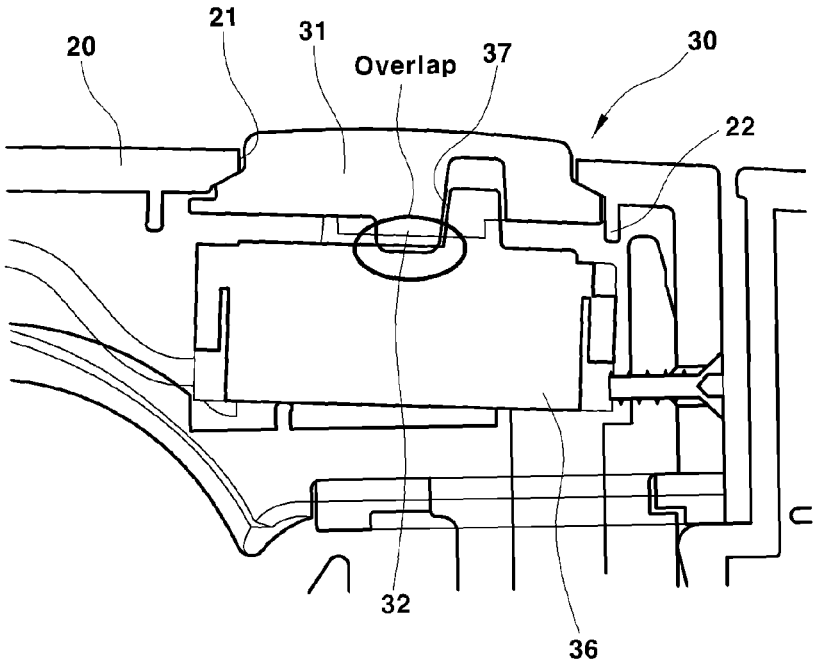
FIG. 3 Prior Art
Figure 4:
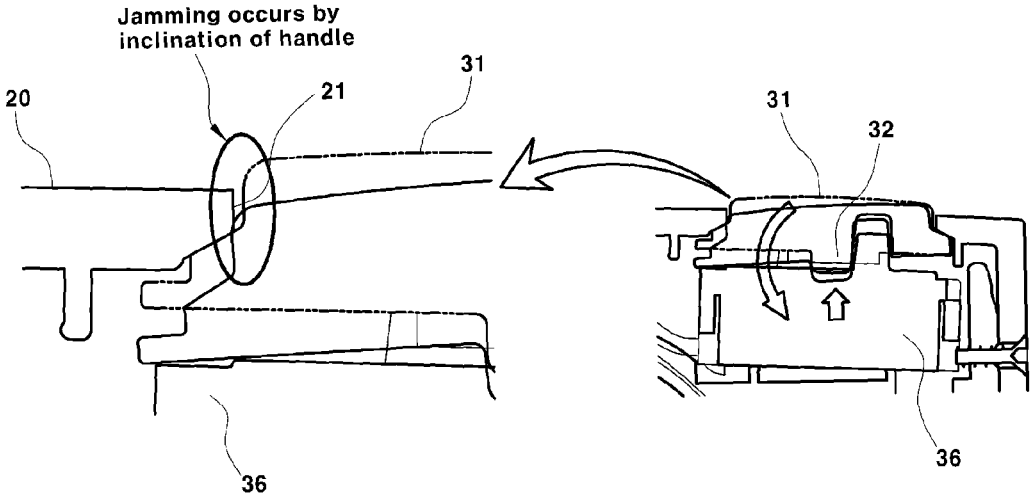
FIG. 4 Prior Art
FIG. 4 is a view illustrating problems of the existing push switch.
Figure 5:
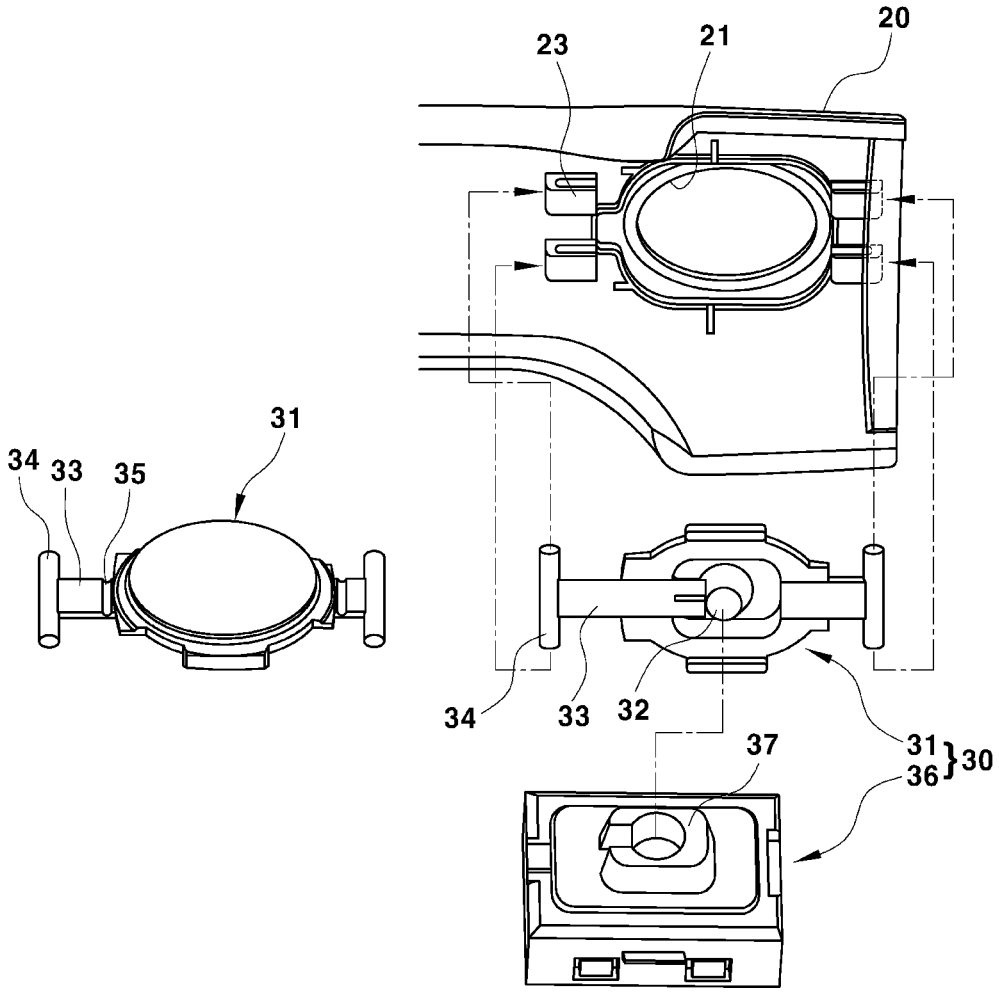
FIG. 5 is a view showing a push switch according to an embodiment of the present inventive concept.

FIG. 5 is a view showing a push switch 30 according to an embodiment of the present disclosure in which a grip cover 20, a button 31, and a tact switch 36 are separated.

Figure 6:
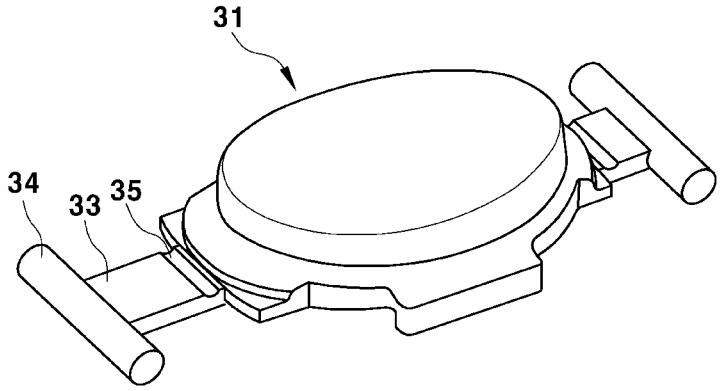
FIG. 6 is a perspective view showing a button of the push switch according to an embodiment of the present inventive concept.
Figure 7:
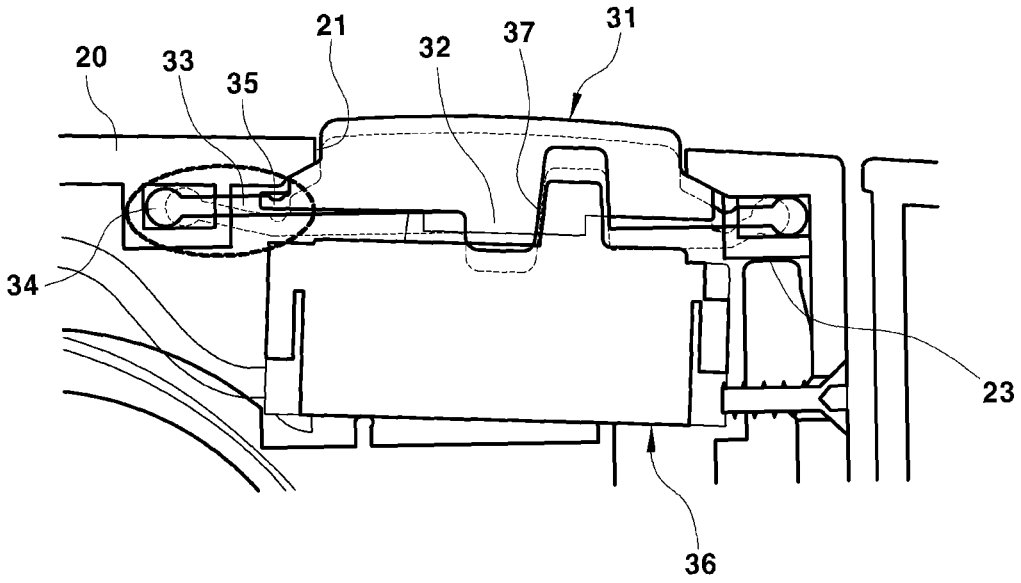
FIG. 7 is a cross-sectional view showing an assembly of the button and a tact switch of the push switch according to the embodiment of the present inventive concept.

FIG. 6 is a perspective view showing a button 31 of the push switch 30 according to an embodiment of the present inventive concept. FIG. 7 is a cross-sectional view showing an assembly of the button 31 and the tact switch 36.

As shown in FIG. 5, the push switch 30 according to the present disclosure includes the button 31 installed inside the grip cover 20. The button 31 is exposed to the outside through a hole 21 of the grip cover 20 and the tact switch 36 is pressed and operated by a push protrusion 32 of the button 31 when the button 31 is pushed.

The push switch 30 of the present disclosure is configured such that the upper side of the button is exposed through a hole 21 of the grip cover 20 and the tact switch 36 is positioned below the button 31 in the grip cover 20.

The tact switch 36 and the push protrusion 32 of the button 31 are not different from those of existing push switches and their descriptions will be omitted.

The push switch 30 according to the present disclosure is configured such that the button 31 is coupled to an inner surface of the grip cover 20 by a hinge-coupling structure 23. Both sides of the button 31 of the grip cover 20 are supported by the hinge-coupling structure 23 to prevent the button 31 from being inclined or rotating, so that sloping and jamming are generally avoided.

With reference to FIGS. 5 and 6, supports 33 extend from both sides of the button 31 and connect to hinges 34, which may have circular cross-sections. The hinges 34 are integrally formed and extend perpendicularly from the ends of the supports 33.

The supports 33 may also include concave bending portions 35 that bend when the button 31 is pushed.

On the inner surface of the grip cover 20, coupling units 23 may be formed such that the both ends of the hinges 34 may be inserted thereinto to limit the movement of the hinges 34 when the button 31 is operated.

The hinges 34 extend from the ends of the supports 33 and are inserted into the coupling units 23 to support and secure the button 31.

In the above configuration, the hinges 34 are to hinge the button 31 to the grip cover 20. The bending portions 35 of the plastic button 31 are elastically deformed when the button 31 is pushed and operated such that the bending portions 35 are bent when the button 31 is pushed and the bent shape of the bending portions 35 provides a resilient force for returning the button 31 to its original state when the push is released.

FIG. 6 shows an example of the button 31 according to the present disclosure. The size and position of the bending portions 35 may be modified to control the operating force as necessary.

Figure 8A:
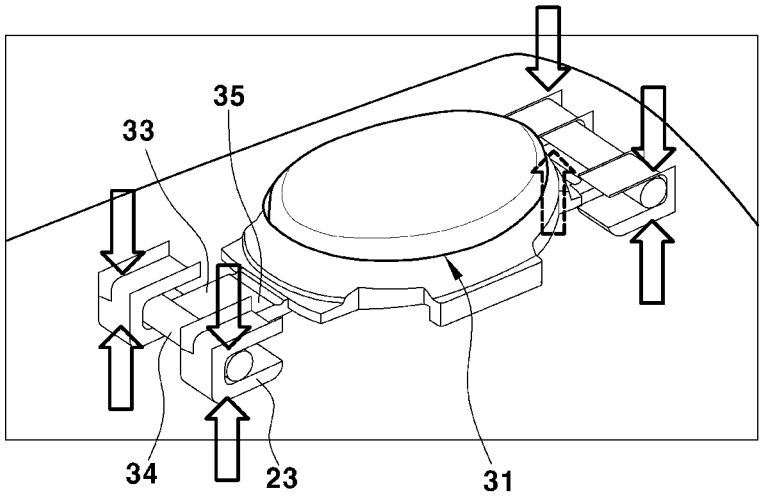
FIGS. 8A and 8B are perspective views showing the button coupled through a hinge to a coupling unit in the push switch according to an embodiment of the present inventive concept.
Figure 8B:
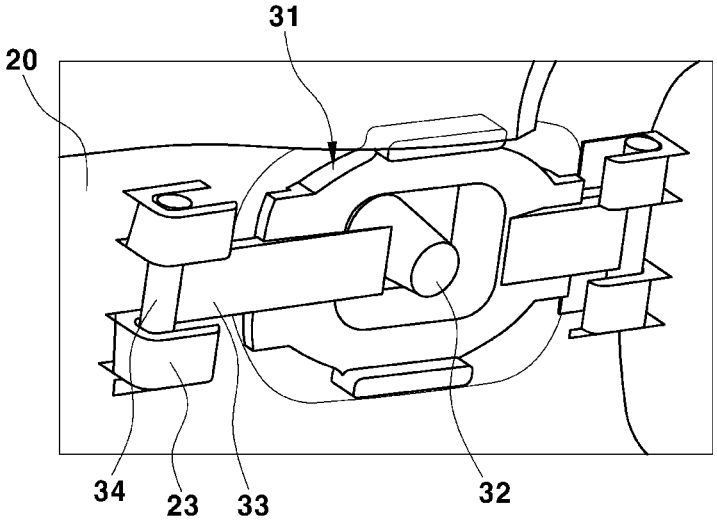

As shown in FIG. 7, the coupling units 23 guide the hinges 34 to move toward the central portion of the button 31 when the button 31 is pushed and the bending portions 35 are elastically deformed. FIGS. 8A and 8B are perspective views showing the support 33 of button 31 attached to the hinge 34 coupled to the coupling unit 23 according to an embodiment of the present disclosure.

As shown, the coupling units 23 protrude from the inner surface of the grip cover 20 in a bent or 'L'-shape to restrict the position of the hinges 34 with respect to the operating direction of the button 31. In this way, the coupling units prevent the button 31 from rotating.

Figure 9A:
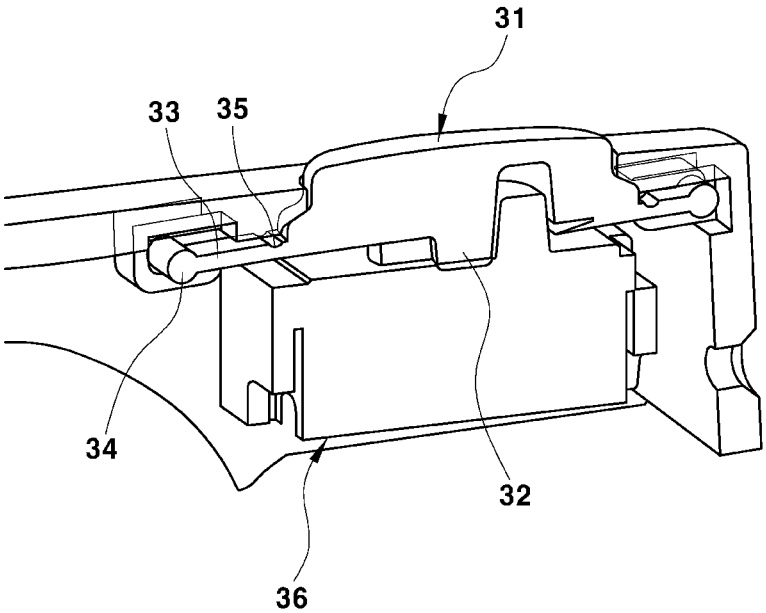
FIGS. 9A and 9B are cross-section views showing states before and after the button is operated in the push switch according to an embodiment of the present inventive concept.
Figure 9B:
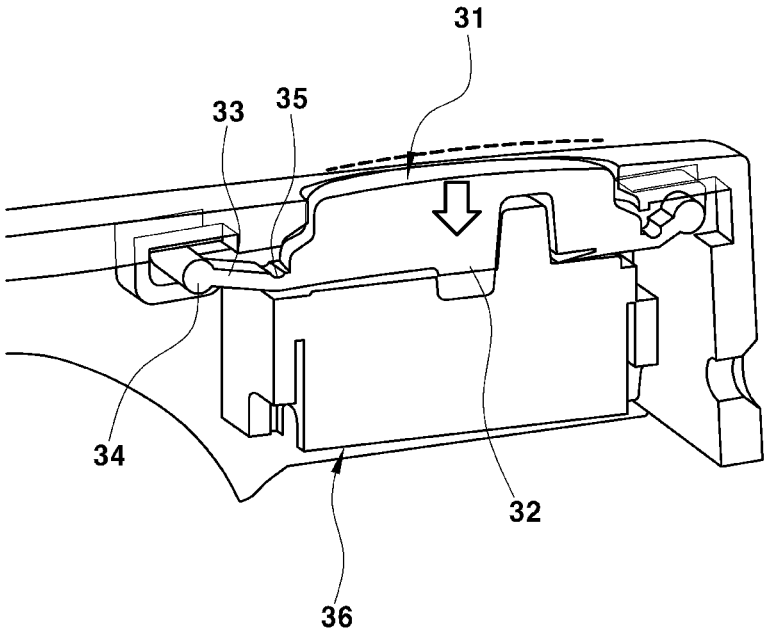

FIGS. 9A and 9B are cross-section perspective views showing an embodiment of the present disclosure before and after operation of the button 31. The position of the button 31 is limited by the hinge-fixing structure supporting the button 31 in the grip cover 20 and the operating force of the button 31 is limited by the resilient force of the supports 33, more specifically the resilient force at the bending portions 35 provided on the supports 33.

In more detail, when the button 31 is pushed in the state as shown in FIG. 9A, the bending portions 35 are bent and elastically deformed, as shown in FIG. 9B, and simultaneously the push protrusion 32 operates the tact switch 36. At this time, since the hinges 34 are guided within the coupling units 23, neither rotation nor jamming of the button 31 occurs.

Since the button 31 is supported at both sides by the hinge-coupling structure 23, the button 31 is neither inclined nor rotated during the operation so that sloping and jamming are diminished.

When the button 31 is released from the pushed state as shown in FIG. 9B, the bent bending portions 35 are restored and the button 31 returns to the state as shown in FIG. 9A due to the resilient force of the bending portions 35.

The operating force is realized not by the widely distributed rubber (of the rubber seal of the tact switch) but rather by the plastic (of the supports of the button) in the push switch according to the present disclosure. It is therefore advantageous to tune and manage this operating force. Using the hinge-coupling structure, the positional distribution of this force is easily managed.

Moreover, as the contact portion between the button and the grip cover is significantly reduced relative to a conventional push switch having guide ribs in contact with the button, problems associated with frozen conditions are reduced.

The present disclosure has been described in detail with reference to embodiments thereof. However, it will be appreciated by those of skill in the art that changes may be made to these embodiments without departing from the principles and spirit of the present disclosure, the scope of which is defined in the appended claims and their equivalents.

What is claimed is:

1. A push switch of an outside handle of a door, comprising:

a button disposed inside a grip cover, wherein the button is attached to an inner surface of the grip cover through a support which extends from a side of the button;

a tact switch pressed when the button is pushed;

a hinge formed at an end of the support; and a coupling unit formed on the inner surface of the grip cover and covering upper and lower sides of the hinge at both ends thereof so as to guide the hinge.

2. The push switch of claim 1, further comprising a bending concave portion of the support that is bent when the button is pushed.

3. The push switch of claim 1, wherein the hinge extends perpendicularly from the end of the support and is coupled to the coupling unit.

4. The push switch of claim 3, wherein the hinge has a circular cross-section.

5. The push switch of claim 1, wherein the coupling unit protrudes from the inner surface of the grip cover in a 'U'-shape.

6. The push switch of claim 1, wherein the coupling unit guides the hinge toward the central portion of the button when the button is pushed.

7. The push switch of claim 1, wherein two supports extend from two sides of the button.

* * * * *